US006149554A

United States Patent [19]

Ferguson

[11] Patent Number: 6,149,554

[45] Date of Patent: Nov. 21, 2000

[54] EXERCISE MACHINE

[76] Inventor: Jack Ferguson, 307 E. Evergreen, San Antonio, Tex. 78212-4419

[21] Appl. No.: 09/262,414

[22] Filed: Mar. 4, 1999

[51] Int. Cl.[7] ..... A63B 69/34

[52] U.S. Cl. ..... 482/83; 482/87; 482/90

[58] Field of Search ..... 482/121, 83–90, 482/60, 64, 66, 70, 140, 52, 79

[56] References Cited

U.S. PATENT DOCUMENTS

| | | | |
|---|---|---|---|
| D. 211,478 | 6/1968 | Margolies | 482/54 |
| 694,226 | 2/1902 | Yancey | 482/83 |
| 2,720,396 | 10/1955 | Pfaus | 482/54 |
| 3,281,148 | 10/1966 | Cummins | 482/87 |
| 4,200,279 | 4/1980 | Lambert, Jr. | 482/100 |
| 4,256,302 | 3/1981 | Keiser et al. | 482/100 |
| 4,635,929 | 1/1987 | Shustack | 482/87 |
| 4,807,871 | 2/1989 | Bryson | 272/76 |
| 5,263,914 | 11/1993 | Simonson et al. | 482/99 |
| 5,279,530 | 1/1994 | Hess | 482/70 |

*Primary Examiner*—Jerome W. Donnelly
*Attorney, Agent, or Firm*—Michael S. Sherrill

[57] ABSTRACT

An exercise machine (1) having a cable (16) connected at a first end to a longitudinally reciprocable target pad (13) and sequentially extending around a first pulley (57) located on a lower crossbar (56) of the machine (1), underneath the target pad (13), and then connected to a spring (17) anchored to a support (18). A pair of handles (14, 15) is attached to legs (4, 5) which support the frame (3) of the machine (1). A user (2) is able to kick the target pad (13) and thereby strengthen muscles and develop coordination needed in the martial arts.

30 Claims, 8 Drawing Sheets

EXERCISE MACHINE

FIELD OF THE INVENTION

The invention relates to exercise machines. More specifically, the invention relates to exercise machines which are useful for isolating and enhancing groups of muscles utilized in karate kicks and punches.

BACKGROUND

In the field of martial arts, numerous exercise machines and training devices have been developed for improving the accuracy and speed of kicking and punching. Teaching correct kicking is very time consuming and rarely mastered. In this field, the goal is to build strength in one's arms and legs in the same manner as a body builder develops different sets of muscles by lifting weights. In developing punching and kicking skills, the aim is to improve timing, coordination, balance and speed in striking a target with considerable force while avoiding the necessity of having another person hold the target and minimizing the risk of injury. Devices such as rubber bands or ankle wraps tied to weights do not correctly posture the user and incorrectly tax the back muscle groups in order to overcome gravity and imbalance. The user quickly becomes tired and because the correct muscles needed to deliver a solid kick are not isolated, the body fails to remember. Gravity works against this type of device. Other devices such as universal gyms utilize weight resistance. However, a typical 180 pound person cannot lift or extend a 500 pound weight with one foot using such a device without the entire body exerting enormous strength, thereby destroying the correct form. Furthermore, such devices do not accommodate jumping or flying front kicks.

In the past, devices have been manufactured which attempt to address the problems associated with martial arts kicking. For example, U.S. Pat. No. 4,749,184 issued to Tobin employs a target at the end of a padded sleeve with an elastic strap encircling the target. A free standing support frame is provided with spaced apart stationary portions in a generally triangular arrangement, the target being pivotally mounted to one of the portions with spring resistance members extending to and being supported by the other portions to resiliently resist pivotal movement of the target.

U.S. Pat. No. 4,491,316 issued to Prince also discloses a padded target which is free to swivel or rotate through a limited angle and includes a cushioned pad with an outer fabric cover and tubular support member which fits over an arm support for the target. Another form of padded target is disclosed in U.S. Pat. No. 4,913,419 issued to McAuliffe and which comprises a polypropylene board with a resilient mounting portion.

U.S. Pat. No. 4,662,630 issued to Dignard et al. discloses another type of striking board, and U.S. Pat. No. 4,564,192 issued to Lebowitz discloses a target which includes a cushioned or padded portion surrounding a support arm. Other representative patents in this field are those issued to Tomko, U.S. Pat. No. 4,309,029; Shustack, U.S. Pat. No. 4,635,929; Bryson, U.S. Pat. No. 4,807,871; Dong, U.S. Pat. No. 4,836,533; Beall, U.S. Pat. No. 4,932,652; Wright, U.S. Pat. No. 4,964,629; Wells, U.S. Pat. No. 5,277,679. Despite the development of such diverse exercise equipment, there still exists a need for a device which teaches correct kicking mechanics in the correct posture, while providing measured and adjustable forms of resistance.

SUMMARY OF THE INVENTION

Figure 1:
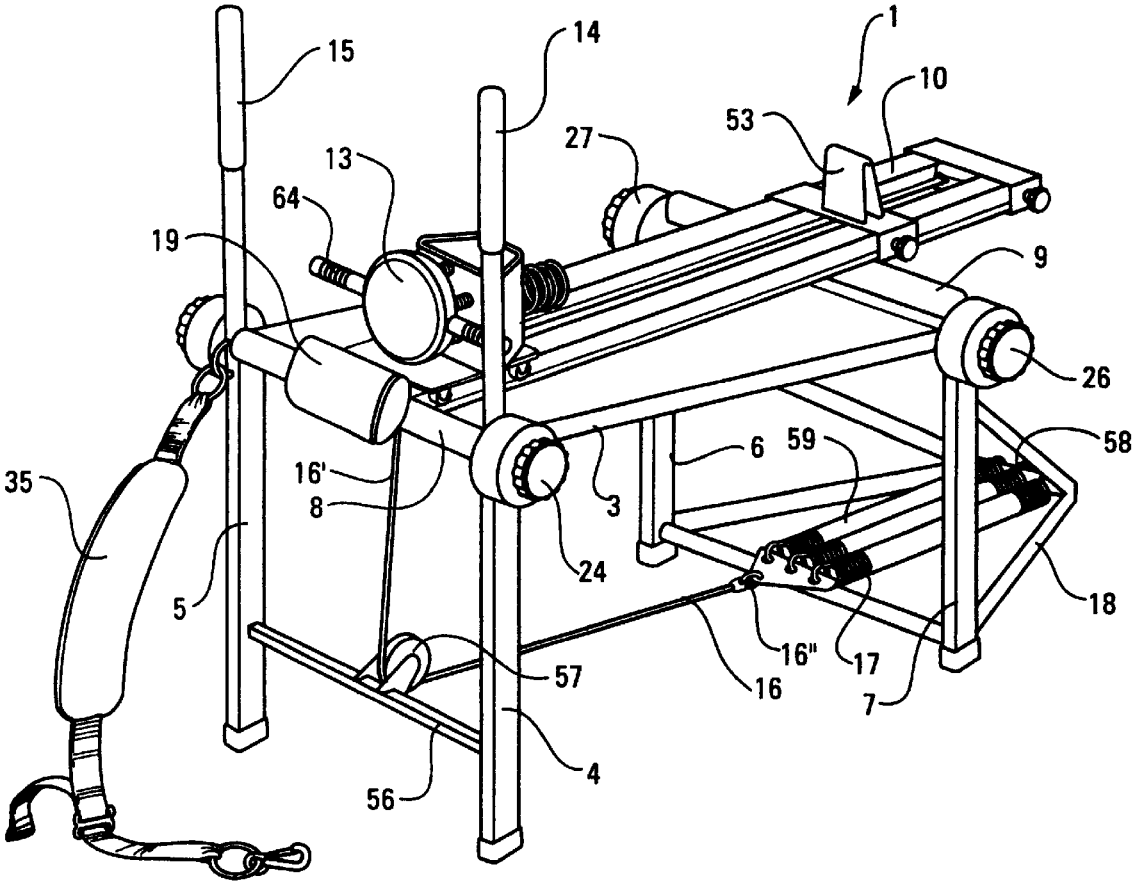
FIG. 1 is a perspective view of a first embodiment of a single leg version of the invention with the adjustable belt feature shown in phantom.

The invention is an exercise machine for martial artists or athletes such as swimmers and runners who need to isolate groups of arm or leg muscles.

Single Leg Version

A first version of the device is directed to single leg exercises and is constructed with (i) two or more tracks forming a rail having a length of about five feet, (ii) a small four wheeled cart which is adapted to move along the rail, (iii) a foot pad or rest attached to the cart, (iv) a rectilinear four legged frame onto which the tracks are pivotably and slidably attached, thereby permitting the height of the rails above a floor surface to be adjusted and to permit adjustment of the angle or inclination between the rails and the floor surface, (v) two or more handles rigidly affixed to the frame to provide a grip for the user who is standing on a single leg, (vi) a belt hooked to the handle bars to provide the user with counter resistance against the force exerted against the foot used for kicking, and (vii) a set of pulleys affixed to the frame through which a steel cable runs, one end of the cable being affixed to the foot pad and the other end of the cable being affixed to a suitable resistance device.

The single leg exercise machine optionally includes (viii) one or more leaf springs as the resistance device, each leaf spring representing a maximum resistive force of approximately fifty pounds, or (ix) one or more coil springs, each coil spring representing a resistive force of approximately fifty pounds. Additional springs may be added as necessary to reach a maximum force of approximately five hundred pounds. The cable is attached to the coil or leaf spring by a hook, the other end of the cable being similarly hooked to the foot pad. An optional handle bar may be inserted on or in place of the foot pad to facilitate arm and stomach strengthening.

The single leg exercise machine is used by simply standing next to the machine in a position which would permit the user to kick. The user lifts the kicking leg and places the foot onto the foot pad. The user fastens the support belt around the waist and then uses the leg to exert a longitudinal force against the pad. The pad is tied by the cable to the interchangeable resistance devices, thereby permitting the user to incrementally increase the strength of the leg. The other leg is exercised in the same manner for the same set of repetitions. The device may be used for side kicks, front kicks, back kicks and frontal punches.

Dual Leg Version

A second version of the device is directed to dual leg exercises and is constructed with (i) two parallel sets of two or more tracks forming a pair of rails having a length of about five feet, (ii) two small four wheeled carts with each cart adapted to independently move along one of the rails, (iii) a foot pad or rest attached to each cart, (iv) a rectilinear four legged frame onto which the tracks are pivotably and slidably attached, thereby permitting the height of the rails above a floor surface to be adjusted and to permit adjustment of the angle or inclination between the rails and the floor surface, (v) two or more handles rigidly affixed to the frame to provide a grip for the user who is suspended over the end of the frame, (vi) a belt hooked to the handle bars to provide the user with counter resistance against the force exerted during exercising, and (vii) two sets of pulleys with each set affixed to the frame and engaging a steel cable running from one of the foot pads to a suitable resistance device.

The dual leg exercise machine optionally includes (viii) one or more leaf springs as the resistance device, each leaf spring representing a maximum resistive force of approximately fifty pounds, or (ix) one or more coil springs, each coil spring representing a resistive force of approximately fifty pounds. Additional springs may be added as necessary to reach a maximum force of approximately five hundred pounds per foot pad. The cable is attached to the coil or leaf spring by a hook, the other end of the cable being similarly hooked to the foot pad. A rotatable handle grip may optionally be mounted on each of the foot pads to facilitate arm and stomach strengthening, with rotation of the handle grips facilitating strengthening of the wrists.

The dual leg exercise machine is used to simulate jump front kicks by suspending a user a distance above the ground with the user's feet pushing against the foot pads and the user's buttocks/lower back exerting pressure against the belt. The user grips the handles for stability and alternately or simultaneously kicks his/her legs so as to simulate a jump front kick. The kicking action may be repeated in a piston-like fashion to achieve an aerobic workout.

DETAILED DESCRIPTION OF THE INVENTION

Including a Best Mode

Nomenclature

01 Single Leg Exercise Machine
02 User
03 Frame
04 First Leg of Frame
05 Second Leg of Frame
06 Third Leg of Frame
07 Fourth Leg of Frame
08 Front Crossmember of Frame
09 Rear Crossmember of Frame
10 First Rail
11 Second Rail
12 Platform
13 Target Pad
14 First Handle Attached to Frame
15 Second Handle Attached to Frame
16 Cable
16' First End of Cable
16" Second End of Cable
17 Coil Spring
18 Support Assembly Attached to Frame
19 Cushion
20 First Leg of User
21 Hand of User
22 Second Leg of User
23 Kicking Foot of User
24 Adjustment Knob
25 Adjustment Knob
26 Adjustment Knob
27 Adjustment Knob
28 Elevated Position of Frame
29 Telescoping Inner Portion of Leg
30 Frame Height
31 Forward Angle of Inclination
32 Forward Inclined Position of Frame
33 Rearward Angle of Inclination
34 Rearward Inclined Position
35 Belt
36 First Conduit on Platform
37 Second Conduit on Platform
38 Bevelled Block
39 Support Knob
40 Threaded Base
41 Forward Face of Bevelled Block
42 Nut
43 Head of Knob
44 Rear Face of Target Pad
45 Spring
46 Spring
47 Spring
48 Spring
49 Arrow Indicating Permitted Motion of Target Pad
59 Arrow Indicating Permitted Motion of Target Pad
51 Coil Spring
52 Rear Face of Bevelled Block
53 Stop
54 Flange on Railing
55 Wheels on Platform
56 Lower Crossmember of Frame
57 First Pulley
58 Spring
59 Spring
60 Leaf Spring
61 Distal End of Leaf Spring
62 Second Pulley
63 Arm of User
64 Handlebar Attached to Target Pad
100 Dual Leg Exercise Machine
110 First Pair of Rails
**110*a*** First Rail
**110*b*** Second Rail
111 Second Pair of Rails
**111*a*** Third Rail
**111*b*** Fourth Rail
**112*a*** First Platform
**112*b*** Second Platform
113 Dual Target Pad Assembly
**113*a*** First Target Pad
**113*b*** Second Target Pad
**116*a*** First Cable
**116*a*'** First End of First Cable
**116*a*"** Second End of First Cable
**116*b*** Second Cable

Figure 2:
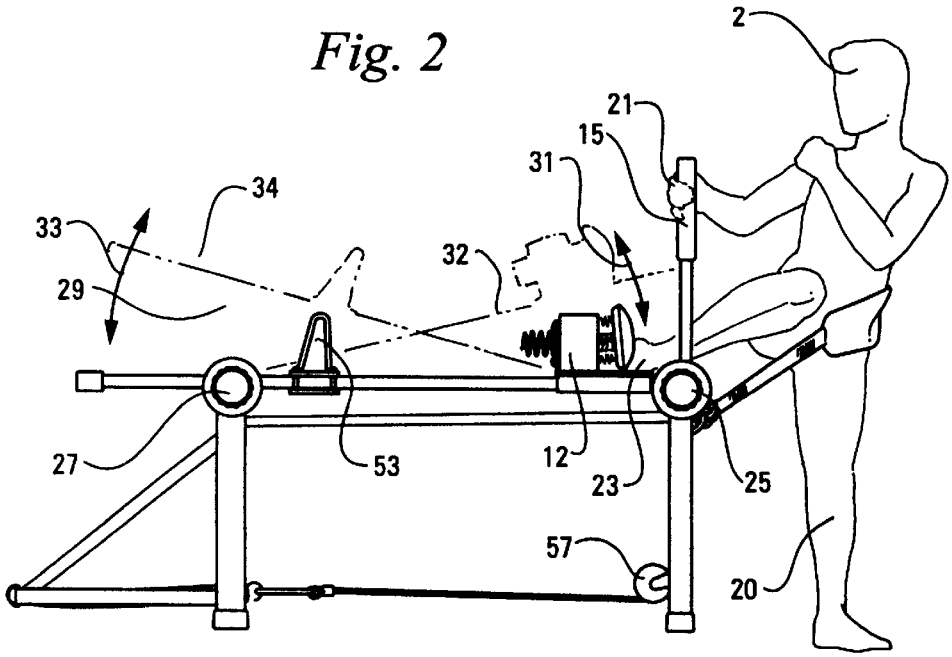
FIG. 2 is a side view of the invention shown in FIG. 1 with the angular adjustment feature of the invention shown in phantom.
Figure 3:
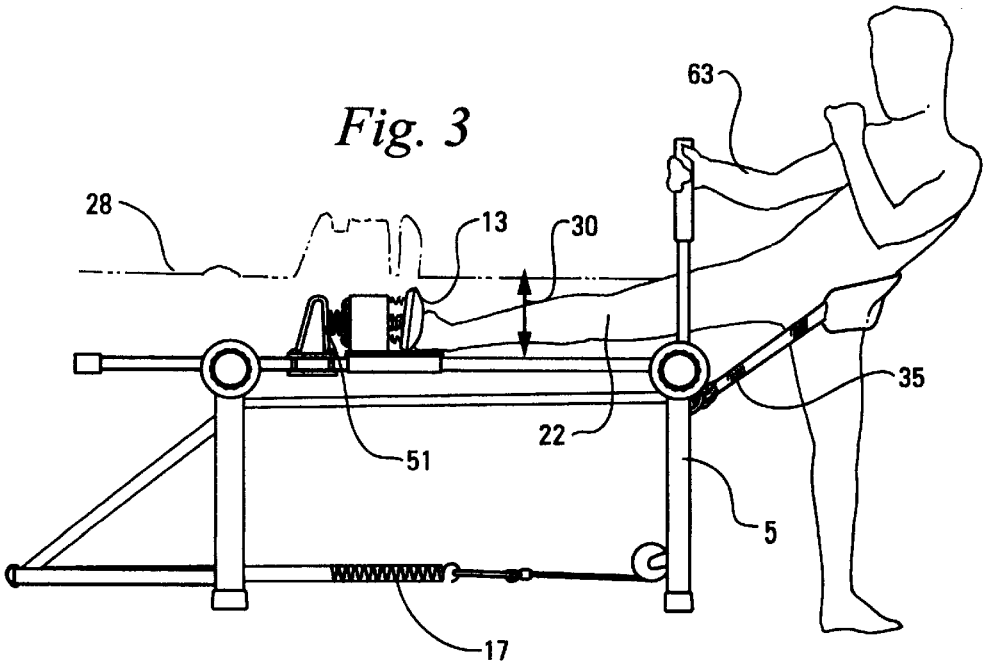
FIG. 3 is a side view of the invention shown in FIG. 2 with the height adjustment feature of the invention shown in phantom.

116*b*' First End of Second Cable
116*b*" Second End of Second Cable
117*a* First Coil Spring
117*b* Second Coil Spring
136*a* First Conduit on Platform
136*b* Second Conduit on Platform
137*a* Third Conduit on Platform
137*b* Fourth Conduit on Platform
138*a* First Bevelled Block
138*b* Second Bevelled Block
139 Support Knob
140 Threaded Base of Support Knob
141 Forward Face of Bevelled Block
142 Nut
143 Head of Support Knob
144 Rear Face of Target Pad
145 Spring
146 Spring
147 Spring
148 Spring
149 Arrow Indicating Permitted Motion of Target Pads
150 Arrow Indicating Permitted Motion of Target Pads
151 Coil Spring
152 Rear Face of Bevelled Block
153 Stop
157*a* First Pulley
157*b* Second Pulley
158 Spring
159 Spring
160*a* First Leaf Spring
160*b* Second Leaf Spring
161*a* Distal End of First Leaf Spring
161*b* Distal End of Second Leaf Spring
162*a* First Secondary Pully
162*b* Second Secondary Pully
164 Handlegrips
164*x* Longitudinal Axis of Handlegrips
170 Hinge Assembly
170*a* First Hinge Half
170*b* Second Hinge Half
171 Hinge Pin Construction Single Leg Version A first version of the invention is a single leg exercise machine 01 in which the user 02 is able to practice karate kicks and punches while strengthening the specific body muscles used in performing such maneuvers. Referring to FIGS. 1–3, the single leg exercise machine 01 includes (i) a frame 03 having legs 04, 05, 06 and 07, (ii) pivotable and slidable front crossmember 08 (extending between legs 04 and 05) and rear crossmember 09 (extending between crossmembers 06 and 07), (iii) a pair of rails 10 and 11 extending between the crossmembers 08 and 09, (iv) a slidable platform 12 mounted on and extending between the rails 10 and 11, (v) a foot or target pad 13 mounted on the platform 12, and (vi) a pair of handles 14 and 15 attached to the legs 04 and 05, respectively.

The single leg exercise machine 01 preferably includes various means for resisting longitudinal movement of the target pad 13, including a line or cable 16 with a first end 16' attached to the slidable platform 12 and a second end 16" attached to at least one coil spring 17 which is anchored to the support 18 extending between legs 06 and 07. Additional coil springs 58 and 59 may be added to increase resistance according to the strength and level of development of user 02. When the coil spring 17 is completely retracted, the slidable platform 12 is biased or urged to be in a position that is adjacent to the crossmember 08. A lower crossmember 56 extends between the frame legs 04 and 05. A first pulley 57 is centrally mounted on the crossmember 56 to guide the cable 16 between the coil spring 17 and the platform 12. In order to prevent injury to the user 02 in the event of an errant kick or punch, a bevelled cushion 19 is affixed to the crossmember 08.

The user 02 stands next to crossmember 08 while balanced on one leg 20. In order to maintain balance, the user 02 may grip handle 15 with hand 21. A belt 35 is fastened to the frame legs 04 and 05 so as to surround and support the user 02 during the actual kicking motion. The user's other leg 22 is raised so that the foot 23 will contact target pad 13. The desired height of the target pad 13 will vary depending on the specific type of kick being practiced and the specific muscles sought to be strengthened, as well as the height of the user 02. In order to make the necessary height adjustment, the position of the frame 03 can be altered by first loosening knobs 24 and 25 located at opposite ends of crossmember 08, along with knobs 26 and 27 located at opposite ends of the rear crossmember 09. The frame 03 may then be raised to the desired frame height 30 as shown at elevated position 28, for example, and the knobs 24 through 27 retightened. The legs 04 through 07 which support frame 03 may be constructed with a telescoping inner portion 29 or may be of uniform cross section and of sufficient height to permit any desired adjustment. If the user 02 wishes to practice a downward kick, an angle of inclination 31 may be selected by raising or lowering crossmember 08 only to achieve the desired inclined position 32 while rear crossmember 09 pivots about knobs 26 and 27. Similarly, if upwardly directed kicks are desired, an angle of inclination 33 may be chosen by raising or lowering rear crossmember 09 until frame 03 achieves inclined position 34 while front crossmember 08 pivots about knobs 24 and 25. A pair of handlebars 64 may be mounted on the target pad 13 to permit exercising of the arms or upper body without the need to actually punch the target.

Figure 4:
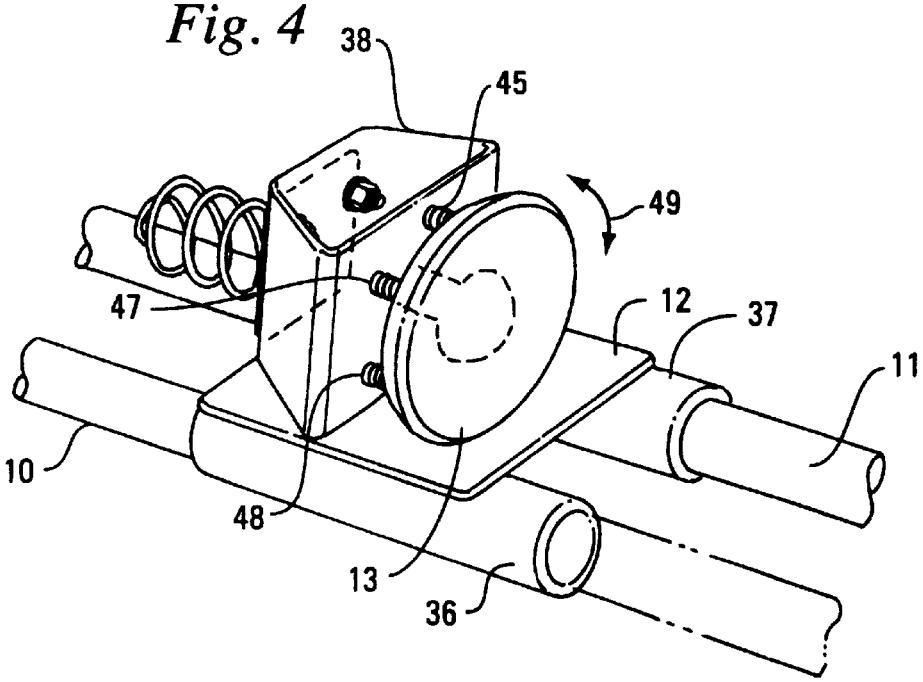
FIG. 4 is perspective view of a first embodiment of a single target pad and its associated components as utilized in the single leg version of the present invention.
Figure 5:
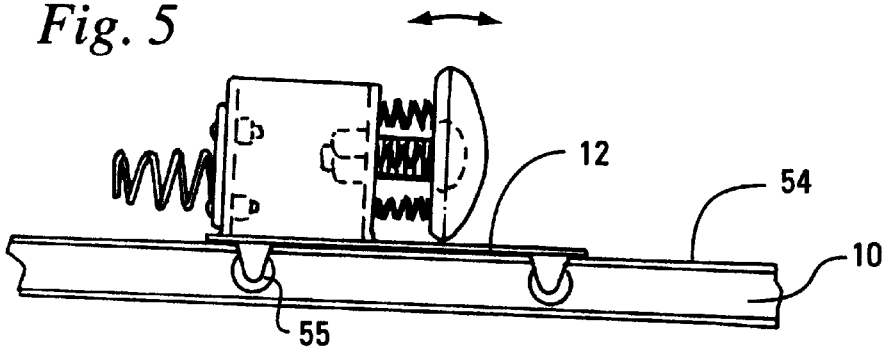
FIG. 5 is a side view of a second embodiment of a single target pad and its associated components as utilized in the single leg version of the present invention.
Figure 6:
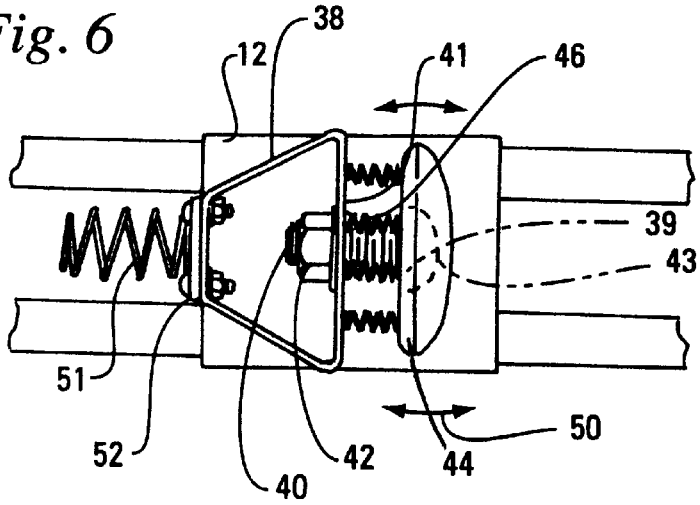
FIG. 6 is a plan view of the target pad depicted in FIG. 4.

Referring also to FIGS. 4 through 6, various aspects of the construction of the target pad 13 and its associated components can be understood. In a first embodiment, the rails 10 and 11 are formed so as to have a substantially circular cross section. The platform 12 is rigidly attached to a first conduit 36 which encircles rail 10, and rigidly attached to a second conduit 37 which encircles rail 11. Mounted on the platform 12 is a bevelled frame or block 38 which is preferably formed of a rigid material such as steel. A central support knob 39 has as threaded base 40 that is secured to the forward face 41 of bevelled block 38 by means of nut 42. The head 43 of the knob 39 is embedded in the target pad 13. Extending substantially perpendicularly from the rear face 44 of target pad 13 are springs 45, 46, 47 and 48, all of which are anchored to frame forward face 41. The placement of the springs 45 through 48 about the rear face 44 permits the target pad 13 to pivot with some degree of resistance about the head 43 in the manner indicated by arrows 49 and 50. A coil spring 51 is affixed to the rear face 52 of bevelled frame 38. When the target pad 13 is advanced by the action of the kicking leg 22, spring 51 contacts and compresses against stop 53 which is adjustably mounted on rails 10 and 11.

A second embodiment of the target pad 13 mounting scheme is shown in FIG. 5. In this arrangement, the rails 10 and 11 are formed with a lip or flange 54. The platform 12 includes wheels 55 that retain the platform 12 in an abutting relationship with the rails 10 and 11.

Figure 7:
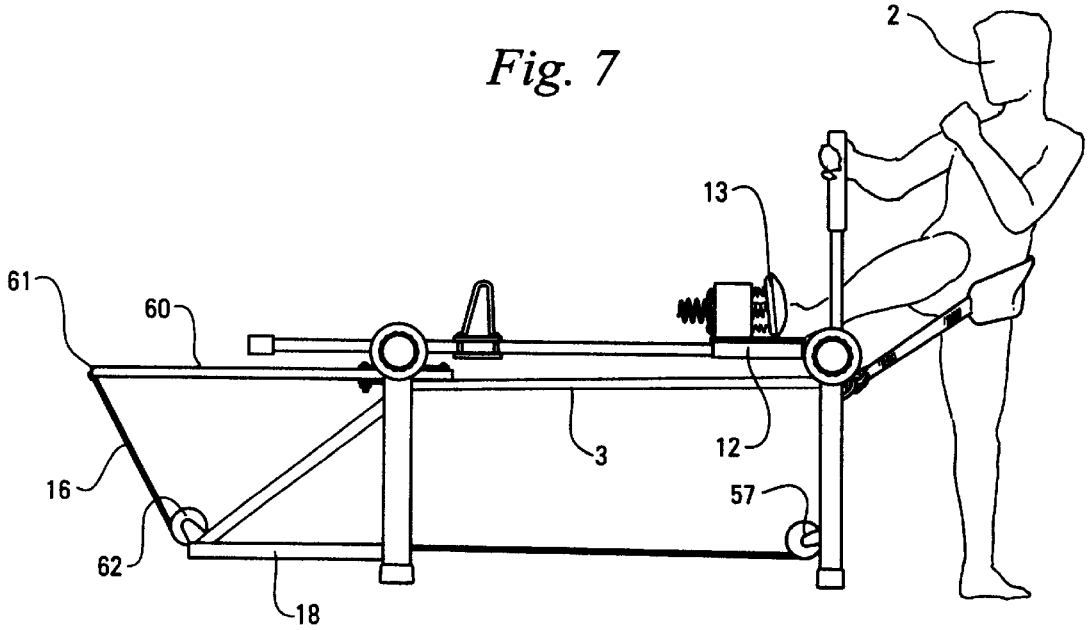
FIG. 7 is a side view of a second embodiment of the single leg version of the invention utilizing a leaf spring as the resistance medium, shown in a first, undeflected position.
Figure 8:
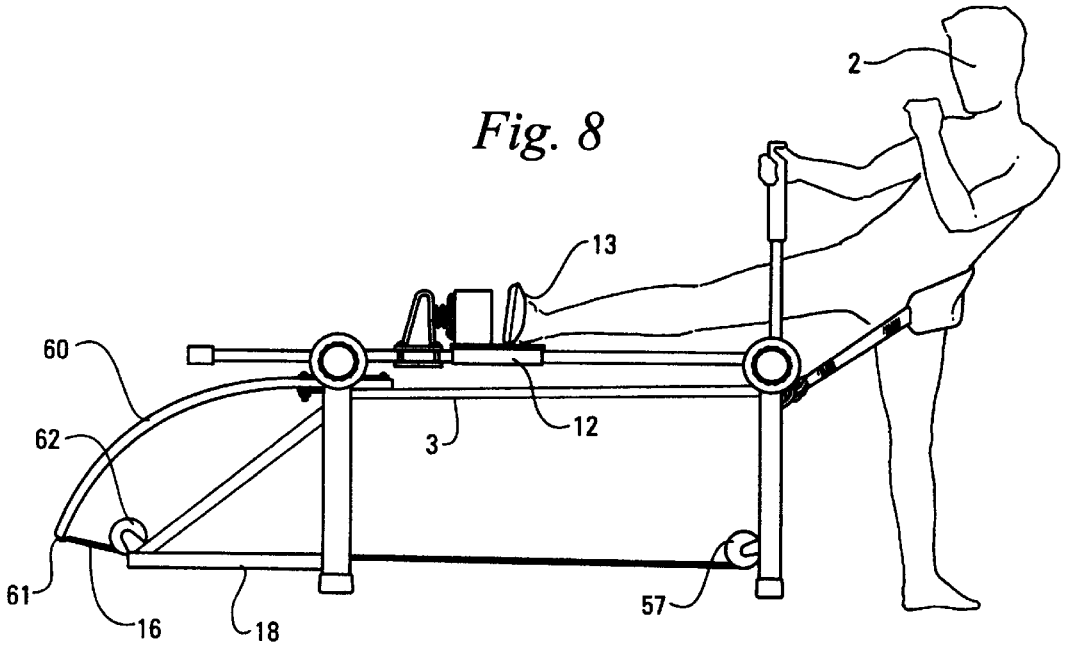
FIG. 8 is a side view of the second embodiment of the single leg version of the invention depicted in FIG. 7 shown in a second, deflected position.

Referring to FIGS. 7 and 8, an alternate manner of providing a means of resistance to the deflection of target pad 13 is disclosed. Cantilevered to frame 03 is a leaf spring 60. The second end 16" of the cable 16 is attached to the distal end 61 of leaf spring 60. A second pulley 62 is mounted on support structure 18 to guide the cable 16 to the first pulley 57 and thus to the slidable platform 12. Movement of the target pad 13 away from user 2 causes the distal end 61 of the leaf spring 60 to deflect downwardly, the resistance offered by spring 60 increasing as the downward deflection increases.

Dual Leg Version

Figure 9:
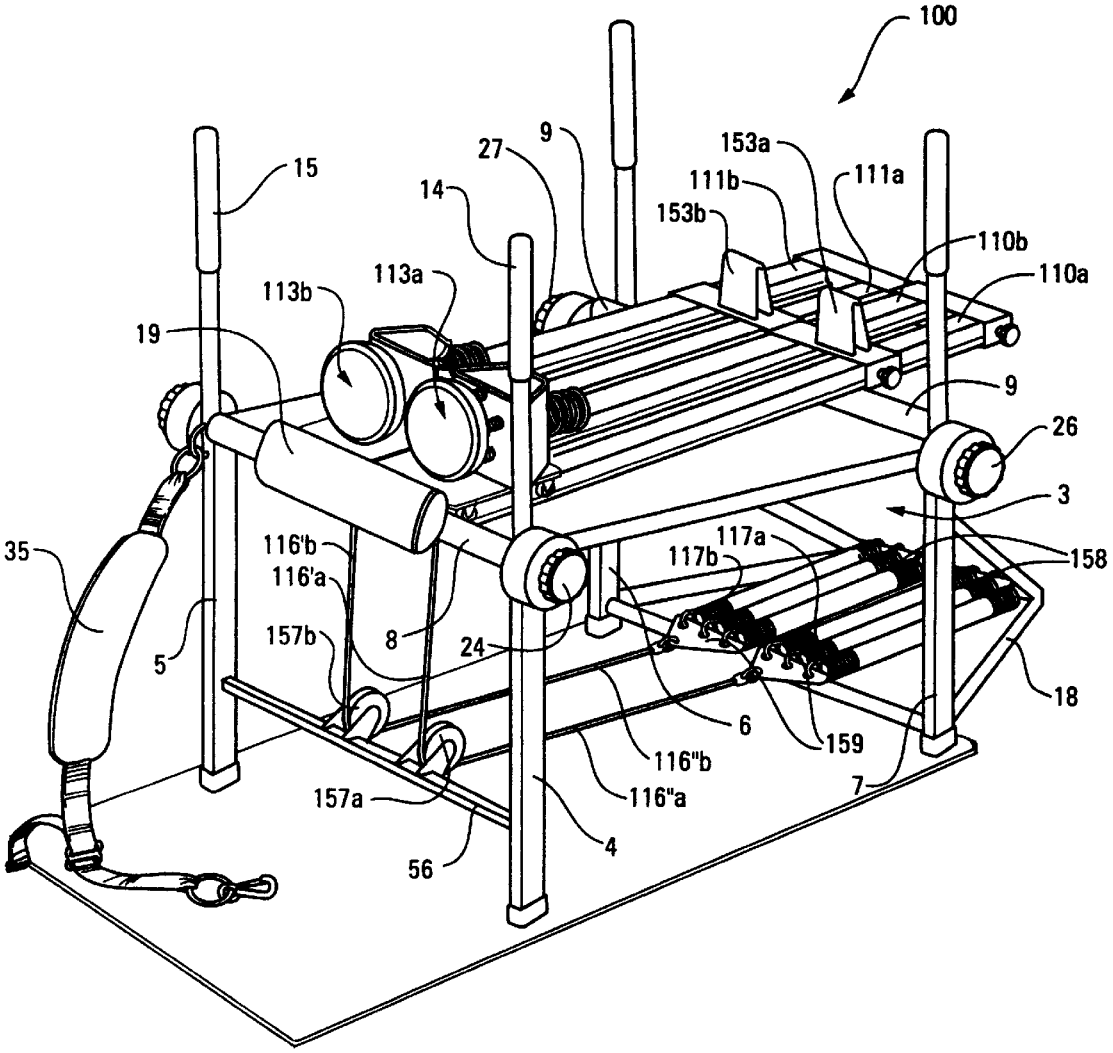
FIG. 9 is a perspective view of a first embodiment of a dual leg version of the invention.
Figure 10:
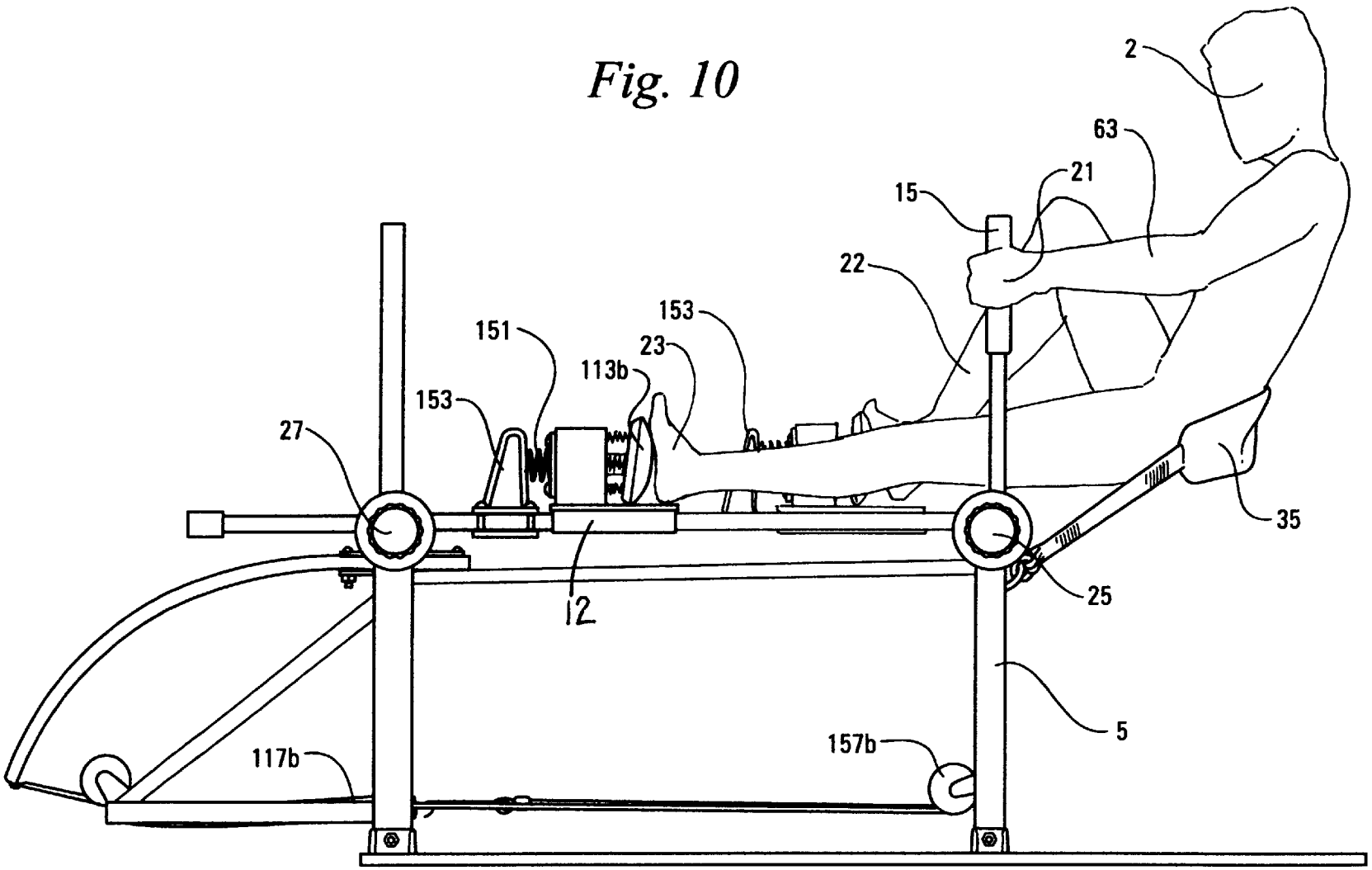
FIG. 10 is a side view of the invention shown in FIG. 9.

The dual leg version of the exercise machine 100 permits the user 02 to practice front jump kicks and punches while strengthening the specific body muscles used in performing such maneuvers. Referring to FIGS. 9 and 10, the dual leg version of the exercise machine 100 includes (i) a frame 03 having legs 04, 05, 06 and 07, (ii) pivotable and slidable front crossmember 08 (extending between legs 04 and 05) and rear crossmember 09 (extending between crossmembers 06 and 07), (iii) a first pair of rails 110 and a second pair of rails 111 extending between the crossmembers 08 and 09, (iv) a first slidable platform 112*a* mounted on and extending between the first pair of rails 110 and a second slidable platform 112*b* mounted on and extending between the second pair of rails 111, (v) a first foot or target pad 113*a* mounted on the first platform 112*a* and a second foot or target pad 113*b* mounted on the second platform 112*b*, and (vi) a pair of handles 14 and 15 attached to the legs 04 and 05, respectively.

The dual leg exercise machine 100 preferably includes various means for independently resisting movement of each of the target pads 113*a* and 113*b* such as a pair of cables 116*a* and 116*b* with a first end 116*a*' and 116*b*' of each cable 116*a* and 116*b* attached to a respective slidable platform 112*a* and 112*b*, and a second end 116*a*" and 116*b*" of each cable 116*a* and 116*b* attached to at least one coil spring 117*a* and 117*b* respectively, with the coil springs 117*a* and 117*b* anchored to a support 18 that extends from legs 06 and 07. Additional coil springs 158 and 159 may be added to each of the coil springs 117*a* and 117*b* to increase resistance according to the strength and level of development of user 02. When a coil spring 117*a* or 117*b* is completely retracted, the corresponding slidable platform 112*a* or 112*b* is biased or urged to be in a position that is adjacent to the crossmember 08. A lower crossmember 56 extends between the frame legs 04 and 05. A first pulley 157*a* is mounted on the lower crossmember 56 to guide the first cable 116*a* between the first coil spring 117*a* and the first platform 112*a*. Similarly, a second pulley 157*b* is mounted on the lower crossmember 56 to guide the second cable 116*b* between the second coil spring 117*b* and the second platform 112*b*.

A belt 35 is fastened to the frame legs 04 and 05 so as to surround and support the user 02 during the actual kicking motion. The user 02 may conveniently enter the exercise machine 100 by facing the machine 100, fastening the belt 35 to frame legs 04 and 05, gripping handles 14 and 15, and then sequentially or simultaneously raising each leg 20 and 22 above the front crossmember 08 and into contact with the corresponding target pads 113*a* or 113*b*. In order to remain suspended above the floor, the user 02 must maintain some level of force against at least one of the target pads 113*a* or 113*b* so as to "wedge" themselves between the target pads 113*a* and 113*b*, and the belt 35. A bevelled cushion 19 can be affixed to the crossmember 08 for purposes of cushioning the area of contact between the frame 03 and the user 02.

As with the single leg version of the exercise machine 01, the desired height of the target pads 113*a* and 113*b* will vary depending on the height of user 02. As described in connection with the single leg version of the exercise machine 01, the height of the frame 03 can be altered by first loosening knobs 25 and 24 located at opposite ends of crossmember 08, along with knobs 26 and 27 located at opposite ends of the rear crossmember 09. The frame 03 may then be raised to the desired frame height 30 and the knobs 24 through 27 retightened. The legs 04 through 07 which support frame 03 may be constructed with a telescoping inner portion 29 or may be of uniform cross section and of sufficient height to permit any desired adjustment. If the user 02 wishes to practice a downward front jump kick, the angle of inclination 31 may be selected by raising or lowering crossmember 08 only to achieve the desired inclined position 32 while rear crossmember 09 pivots about knobs 26 and 27. Similarly, if an upward front jump kick is desired, the angle of inclination 33 may be chosen by raising or lowering rear crossmember 09 until frame 03 achieves inclined position 34 while front crossmember 08 pivots about knobs 24 and 25.

Figure 12:
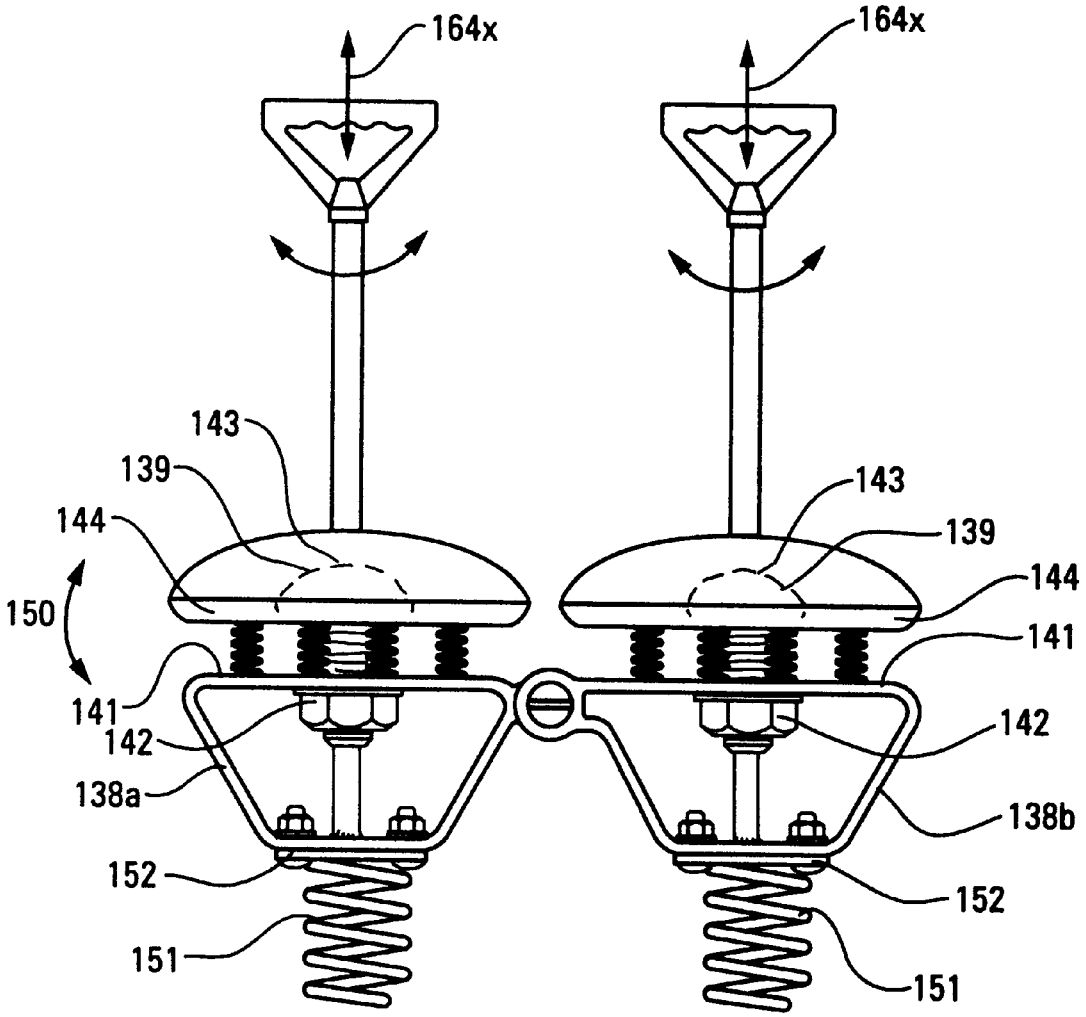
FIG. 12 is a plan view of the target pad depicted in FIG. 11 including the rotational handgrips feature.

As shown in FIG. 12, a longitudinally extending handlegrip 164 can optionally be mounted onto each target pad 113*a* and 113*b* to permit exercising of the arms or upper body without the need to actually punch the target pads 113*a* and 113*b*. The handlegrips 164 can be rotatably attached to the target pads 113*a* and 113*b* so as to rotate about the longitudinal axis 164*x* of the handlegrips 164 for purposes of allowing strengthening of the wrists (unnumbered) and teach proper punching form.

Figure 11:
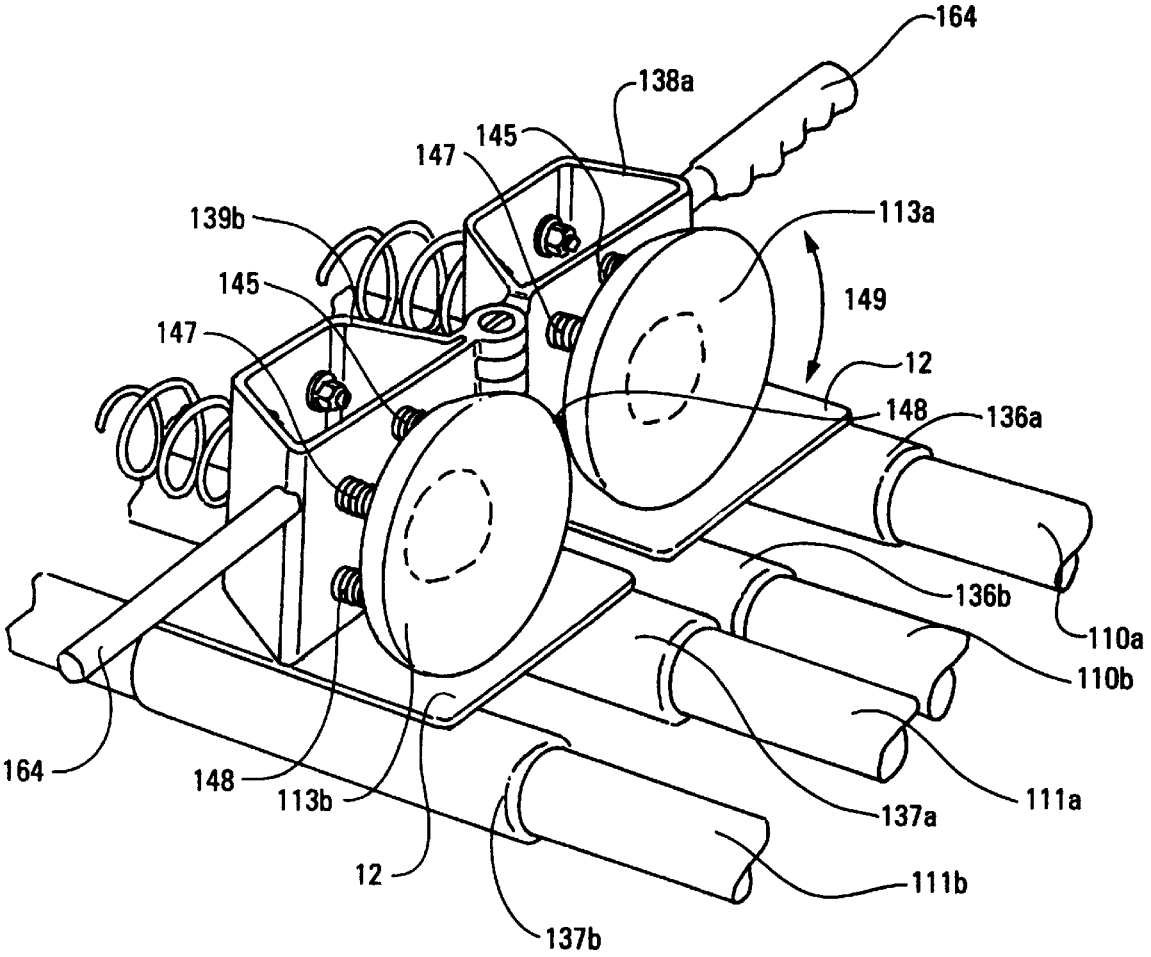
FIG. 11 is perspective view of a dual target pad and its associated components as utilized in the dual leg version of the present invention.

Referring also to FIGS. 11 and 12, various aspects of the construction of the dual target pad assembly 113 and its associated components can be understood. In a first embodiment, the rails 110*a*, 110*b*, 111*a* and 111*b* are formed so as to have a substantially circular cross section. The first platform 112*a* is rigidly attached to a first conduit 136*a* which encircles first rail 110*a* and a second conduit 136*b* which encircles second rail 110*b*. The second platform 112*b* is rigidly attached to a third conduit 137*a* which encircles third rail 111*a* and a fourth conduit 137*b* which encircles fourth rail 111*b*. Mounted on each platform 112*a* and 112*b* is a bevelled frame or block 138*a* and 138*b* respectively, which are preferably formed of a rigid material such as steel. A central support knob 139 with a threaded base 140 is secured to the forward face 141 of each of the bevelled blocks 138*a* and 138*b* by means of a nut 142. The head 143 of each knob 139 is embedded within the respective target pad 113*a* and 113*b*. Extending substantially perpendicularly from the rear face 144 of each of the first and second target pads 113*a* and 113*b* are a set of springs 145, 146, 147 and 148, all of which are anchored so as to frame the forward face 141 of the respective bevelled block 138*a* and 138*b*. The placement of the springs 145, 146, 147 and 148 about the rear face 144 permits the respective target pad 113*a* or 113*b* to pivot with some degree of resistance about the corresponding head 143 of the knob 139 in the manner indicated by arrows 149 and 150. A coil spring 151 is affixed to the rear face 152 of each bevelled block 138*a* and 138*b*. When a target pad 113*a* or 113*b* is advanced by the kicking action of a leg 20 or 22, corresponding spring 151 contacts and compresses against stop 153 which is adjustably mounted on the corresponding pair of rails 110 or 111.

The target pads 113*a* and 113*b* may alternatively be mounted in accordance with the mounting scheme shown in FIG. 5 as discussed in connection with the single leg version of the exercise machine 01.

The bevelled blocks 138*a* and 138*b* can be constructed with a means for reversable connecting the blocks 138*a* and 138*b* to reciprocate along the rails 110 and 111 as a single unit. As shown in FIG. 11, one option for reversable connecting the blocks 138*a* and 138*b* is to provide the blocks 138 with a hinge assembly 170 wherein cooperating hinge halves 170*a* and 170*b* are integrally formed into each bevelled block 138*a* and 138*b*, and a removable hinge pin 171 provided for securing the hinge halves 170*a* and 170*b* together.

Referring to FIG. 10, an alternate manner of providing a means of resistance to the deflection of target pads 113*a* and 113*b* is disclosed. As described in connection with the single leg version of the exercise machine 01, a pair of leaf springs 160*a* and 160*b* is cantilevered to frame 03. Attached to the distal end 161*a* and 161*b* of each leaf spring 160*a* and 160*b* is a second end 116*a*" and 116*b*" of the cable 116*a* or 116*b* respectively. A pair of secondary pulleys 162*a* and 162*b* are mounted on support structure 18 to guide each of the cables 116*a* and 116*b* to the corresponding first pulley 157*a* or 157*b* and thus to the corresponding slidable platform 112*a* or 112*b*. Movement of each target pad 113*a* or 113*b* away from the user 02 causes the distal end 161*a* or 161*b* of the corresponding leaf spring 160*a* or 160*b* to deflect downwardly, with the resistance offered by the deflected spring 160*a* or 160*b* increasing as the downward deflection increases.

Use

Single Leg Version

The single leg exercise machine 01 is used by simply standing next to the front crossmember 08, balancing upon one leg 20, fastening belt 35 about their body, gripping one of the handles 14 or 15, and then pushing or thrusting the other leg 22 toward the target pad 13 so as to move the target pad 13 towards stop 53.

The user 02 longitudinally reciprocates the leg 22 by (i) extending the leg 22 while pulling on the handle 15 with the arm 63 so as to contact with foot 23 the target pad 13, and then (ii) displacing the foot 23 away from the body while pushing on the target pad 13 with the leg 22 so as to resist and overcome the compressive force of the spring 17 until the target pad 13 has reached stop 53, at which time the leg 22 is pulled away from the target pad 13 and the user 02 is again able to assume a normal standing position.

Dual Leg Version

The dual leg exercise machine 100 is entered by (i) pulling the belt 35 around the user 02 and fastening the ends of the belt 35 to frame legs 04 and 05, (ii) gripping both handles 14 and 15, and then (iii) raising each leg 20 and 22 above the front crossmember 08 and into contact with the corresponding target pad 113*a* and 113*b*. In order to remain suspended above the floor (unnumbered), the user 02 must maintain some level of force against at least one of the target pads 113*a* or 113*b* so as to "wedge" themselves between the target pad 113*a* and/or 113*b* and the belt 35.

Upon entering the dual leg exercise machine 100 the user 02 may alternately or simultaneously longitudinally reciprocating the legs 20 and 22 by extending the legs 20 and 22 so as to overcome the compressive force of the coil spring 117*a* and/or 117*b* attached to the corresponding target pad 113*a* and/or 113*b* and move the target pad 113*a* and/or 113*b* until it reaches the associated stop 153, and then retracting the extended leg 22 so as to allow the target pad 113*a* and/or 113*b* to return towards the user 02.

I claim:

1. An exercise machine comprising:

(a) a frame having front and rear crossmembers;

(b) at least one rail connected to the frame, the rail extending between the front and rear crossmembers of the frame;

(c) a first pulley connected to the frame in a region beneath the front crossmember of the frame;

(d) a spring connected to the frame in a region adjacent to the rear crossmember of the frame;

(e) a platform slidably mounted on the rail for longitudinally reciprocating between the front and rear crossmembers;

(f) a cable connected at a first end to the spring and sequentially extending from the spring (i) underneath the platform, (ii) around the first pulley and (iii) around the front crossmember wherein a second end of the cable is affixed to the platform;

(g) at least one handle attached to the frame in region adjacent to the front crossmember; and (h) a belt affixed to the front crossmember for supporting a user standing near the machine.

2. The exercise machine of claim 1 further comprising a target pad mounted on the platform, the target pad being adapted to contact a foot of a user standing near the machine.

3. The exercise machine of claim 2 further comprising a means for adjusting the rail between first and second vertical positions.

4. The exercise machine of claim 3 further comprising (i) means for pivoting the front crossmember about a longitudinal axis of the front crossmember, and (ii) means for angularly adjusting an angle of inclination of the rail.

5. The exercise machine of claim 4 further comprising a stop mounted on the rail, the stop being positioned to limit longitudinal travel of the platform on the rail.

6. The exercise machine of claim 5 wherein the rear crossmember is mounted on the frame so as to pivot about its longitudinal axis, the rear cross member being mounted on the frame such that its longitudinal axis is in a substantially horizontal orientation.

7. The exercise machine of claim 6 wherein (i) the front crossmember is substantially parallel to the rear crossmember, (ii) the first crossmember may be raised and lowered without affecting a vertical position of the rear crossmember, (iii) the rear crossmember may be raised and lowered without affecting a vertical position of the front crossmember, and (iv) either end of the rail may thereby be raised or lowered so as to tilt the rail with respect to a horizontal plane.

8. The exercise machine of claim 7 further comprising (i) a means for adjusting a total resistive force exerted against movement of the platform, and (ii) a means for securing the front and rear crossmembers against rotation about their respective longitudinal axis.

9. The exercise machine of claim 8 further comprising a pad mounted on a central region of the front crossmember.

10. The exercise machine of claim 9 wherein the spring includes a plurality of coil springs, each coil spring being removable so as to adjust the total resistive force exerted against movement of the platform.

11. The exercise machine of claim 9 wherein the spring is formed as a cantilevered leaf spring having a fixed end anchored to the frame in a region adjacent to the rear crossmember.

12. The exercise machine of claim 11 wherein a free end of the cantilevered leaf spring is affixed to the first end of the cable such that rearward deflection of the platform causes a downward deflection of the free end of the cantilevered leaf spring.

13. The exercise machine of claim 12 wherein the rail is formed as a cylinder.

14. The exercise machine of claim 13 further comprising at least one conduit, the conduit being rigidly affixed to the platform and encircling the rail.

15. The exercise machine of claim 16 wherein rail may be tilted with respect to a horizontal plane through an angle of between zero and thirty degrees, the rear crossmember being the apex of the angle, thereby permitting the user of the machine to practice a downward kick when directing their foot at the target pad.

16. The exercise machine of claim 15 wherein the rail may be tilted with respect to a horizontal plane through an angle of between zero and thirty degrees, the front crossmember being the apex of the angle, thereby permitting the user of the machine to practice an upward kick when directing their foot at the target pad.

17. A method of exercising, using the exercise machine of claim 1, comprising:

(a) standing on one foot adjacent to the front crossmember;

(b) raising one foot in preparation for kicking with that foot;

(c) gripping the handles with one hand; and (d) longitudinally reciprocating the raised foot by (i) extending the raised leg in the direction of a target pad mounted on the platform, and (ii) striking the target pad with the raised foot while pushing on the target pad with the raised leg so as to overcome a resistance exerted by the spring.

18. A single leg exercise machine comprising:

(a) a frame having four substantially vertical legs adapted to support the frame on a substantially horizontal surface;

(b) an upper front crossmember extending laterally between two forwardmost legs of the frame;

(c) a lower front crossmember extending laterally between the two forwardmost legs of the frame;

(d) a rear crossmember extending laterally between two rearwardmost legs of the frame;

(e) a pair of rails extending between the upper front crossmember and the rear crossmember;

(f) a means for vertically adjusting the upper front crossmember to achieve an elevated position of the rails;

(g) a platform slidably mounted on the rails such that the platform may be reciprocated between the upper front crossmember and the rear crossmember;

(h) a cable connected at a first end to the platform and sequentially extending from the platform (i) around the upper front crossmember, (ii) through a first pulley affixed to the lower front crossmember and (iii) to a resilient force resisting element affixed to the frame in a region beneath the rear crossmember;

(i) a handle attached to at least one of the forwardmost legs of the frame and extending vertically above the upper front crossmember; and (j) a belt affixed to the upper front crossmember for supporting a user standing near the machine.

19. A method of exercising, using the exercise machine of claim 18 comprising:

(a) standing in front of the upper front crossmember;

(b) balancing on one foot;

(c) gripping one of the handles with one hand; and (d) longitudinally reciprocating the slidable platform by (i) extending a raised foot to strike a target mounted on the platform, and (ii) overcoming a force exerted by the resilient force resisting element.

20. An exercise machine comprising:

(a) a frame having front and rear crossmembers;

(b) a belt affixed to the front crossmember;

(c) at least two substantially parallel rails connected to the frame, the rails extending between the front and rear crossmembers of the frame;

(d) a first pulley and a second pulley connected to the frame in a region beneath the front crossmember of the frame;

(e) a first spring and a second spring connected to the frame in a region adjacent to the rear crossmember of the frame;

(f) a first platform slidably mounted on the first rail for longitudinally reciprocating between the front and rear crossmembers;

(g) a second platform slidably mounted on the second rail for longitudinally reciprocating between the front and rear crossmembers;

(h) a first cable connected at a first end to the first spring and sequentially extending from the first spring (i) underneath the platform, (ii) around the first pulley and (iii) around the front crossmember wherein a second end of the first cable is affixed to the first platform;

(i) a second cable connected at a first end to the second spring and sequentially extending from the second spring (i) underneath the platform, (ii) around the second pulley and (iii) around the front crossmember wherein a second end of the second cable is affixed to the second platform; and (j) a pair of handles attached to the frame in a region adjacent to the front crossmember.

21. The exercise machine of claim 20 further comprising a target pad mounted on each platform, the target pads being adapted to contact a foot of a user standing near the machine.

22. The exercise machine of claim 21 further comprising a means for adjusting the rail between first and second vertical positions.

23. The exercise machine of claim 22 further comprising (i) means for pivoting the front crossmember about a longitudinal axis of the front crossmember, and (ii) means for angularly adjusting an angle of inclination of the rails.

24. The exercise machine of claim 23 further comprising a stop mounted on each rail, the stops being positioned to limit longitudinal travel of each platform on the corresponding rail.

25. The exercise machine of claim 20 further comprising a means for independently adjusting a total resistive force exerted against movement of each platform.

26. The exercise machine of claim 20 further comprising a pad mounted on a central region of the front crossmember.

27. The exercise machine of claim 20 wherein the first and second springs each include a plurality of coil springs, with each coil spring being removable so as to adjust the total resistive force exerted against movement of the platform connected to the spring.

28. The exercise machine of claim 20 wherein the first and second springs are formed as a cantilevered leaf spring having a fixed end anchored to the frame in a region adjacent to the rear crossmember.

29. The exercise machine of claim 20 further comprising at least one conduit rigidly affixed to each platform and encircling one of the rails.

30. A method of exercising, using the exercise machine of claim 21 comprising:

(a) securing both ends of the belt to the frame;

(b) gripping both handles;

(c) placing a foot into contact with each of the target pads while exerting a suspending force against at least one of the target pads and the belt; and (d) longitudinally reciprocating the legs so as to overcome a resistance exerted by the springs.

* * * * *

UNITED STATES PATENT AND TRADEMARK OFFICE

CERTIFICATE OF CORRECTION

PATENT NO. : 6,149,554
DATED : November 21, 2000
INVENTOR(S) : Ferguson

It is certified that error appears in the above-identified patent and that said Letters Patent is hereby corrected as shown below:

Column 11,
Line 1, replace "16" with -- 14 --

Column 12,
Line 58, replace "21" with -- 20 --

Signed and Sealed this

Twenty-fifth Day of December, 2001

*Attest:*

*Attesting Officer*

JAMES E. ROGAN
*Director of the United States Patent and Trademark Office*